US008915427B2

(12) United States Patent
Dietz et al.

(10) Patent No.: US 8,915,427 B2
(45) Date of Patent: Dec. 23, 2014

(54) METHOD FOR TRANSPORTING VALUE NOTES

(75) Inventors: Oliver Dietz, Borchen (DE); Dietmar Molitor, Paderbom (DE)

(73) Assignee: Wincor Nixdorf International GmbH (DE)

( * ) Notice: Subject to any disclaimer, the term of this patent is extended or adjusted under 35 U.S.C. 154(b) by 19 days.

(21) Appl. No.: 13/811,405

(22) PCT Filed: Jul. 22, 2011

(86) PCT No.: PCT/EP2011/062597

§ 371 (c)(1),
(2), (4) Date: Jan. 28, 2013

(87) PCT Pub. No.: WO2012/010681

PCT Pub. Date: Jan. 26, 2012

(65) Prior Publication Data

US 2013/0119126 A1 May 16, 2013

(30) Foreign Application Priority Data

Jul. 22, 2010 (DE) ..... 10 2010 036 578

(51) Int. Cl.
*G07F 19/00* (2006.01)
*G07D 11/00* (2006.01)

(52) U.S. Cl.
CPC ..... *G07D 11/0069* (2013.01); *G07D 11/0072* (2013.01); *G07D 11/006* (2013.01); *G07D 11/0057* (2013.01)
USPC ..... 235/379; 235/380

(58) Field of Classification Search
USPC ..... 235/379, 380
See application file for complete search history.

(56) References Cited

U.S. PATENT DOCUMENTS 4,670,643 A * 6/1987 Hain et al. ..... 235/379
6,402,025 B1 * 6/2002 Shepherd et al. ..... 235/379
6,935,558 B2 * 8/2005 Washington et al. ..... 235/380

(Continued)

FOREIGN PATENT DOCUMENTS

DE 10-2004-061467 A1 6/2006
DE 10-2007-014176 A1 8/2008

(Continued)

OTHER PUBLICATIONS

International Preliminary Report on Patentability (Chapter I of the Patent Cooperation Treaty) for PCT/EP2011/062597, (in English), issued Jan. 22, 2013.

(Continued)

*Primary Examiner* — Paultep Savusdiphol
(74) *Attorney, Agent, or Firm* — Harness, Dickey & Pierce, P.L.C.

(57) ABSTRACT

A method for controlling a cycle of notes of value, wherein by a security transport company a cash box is removed from and/or inserted into a device for handling notes of value. The removal and/or the supplying of the cash box are detected by means of a sensor. After removal of a cash box from the device the total value of all notes of value received in the cash box is read out from the memory region of a memory element and is subtracted from a value stored in an account memory element assigned to the security transport company. After insertion of a cash box the total value is added to the value of the account memory element.

18 Claims, 1 Drawing Sheet

(56) References Cited

U.S. PATENT DOCUMENTS

| | | | | |
|---|---|---|---|---|
| 6,976,634 | B2 * | 12/2005 | Washington et al. | 235/486 |
| 7,341,179 | B2 * | 3/2008 | Tocher et al. | 235/379 |
| 8,317,089 | B2 | 11/2012 | Brexel et al. | |
| 2001/0054643 | A1 * | 12/2001 | Siemens | 235/379 |
| 2005/0116032 | A1 * | 6/2005 | Tripp et al. | 235/384 |
| 2007/0187485 | A1 * | 8/2007 | Aas et al. | 235/379 |
| 2008/0061127 | A1 * | 3/2008 | Brexel | 235/379 |
| 2008/0301049 | A1 * | 12/2008 | Dyson | 705/42 |
| 2009/0032580 | A1 * | 2/2009 | Blachowicz et al. | 235/379 |
| 2011/0131117 | A1 * | 6/2011 | Schneider et al. | 705/30 |
| 2011/0181416 | A1 * | 7/2011 | Dietz et al. | 340/568.7 |
| 2012/0276881 | A1 * | 11/2012 | Seibert | 455/414.1 |
| 2012/0323361 | A1 | 12/2012 | Brexel et al. | |

FOREIGN PATENT DOCUMENTS

| | | | |
|---|---|---|---|
| DE | 10-2008-023244 | A1 | 11/2009 |
| EP | 1530170 | A1 | 5/2005 |
| WO | WO-2008-141679 | A1 | 11/2008 |

OTHER PUBLICATIONS

International Search Report (in German and English) and Written Opinion (in German) for PCT/EP2011/062597, mailed Nov. 28, 2011; ISA/EP.

* cited by examiner

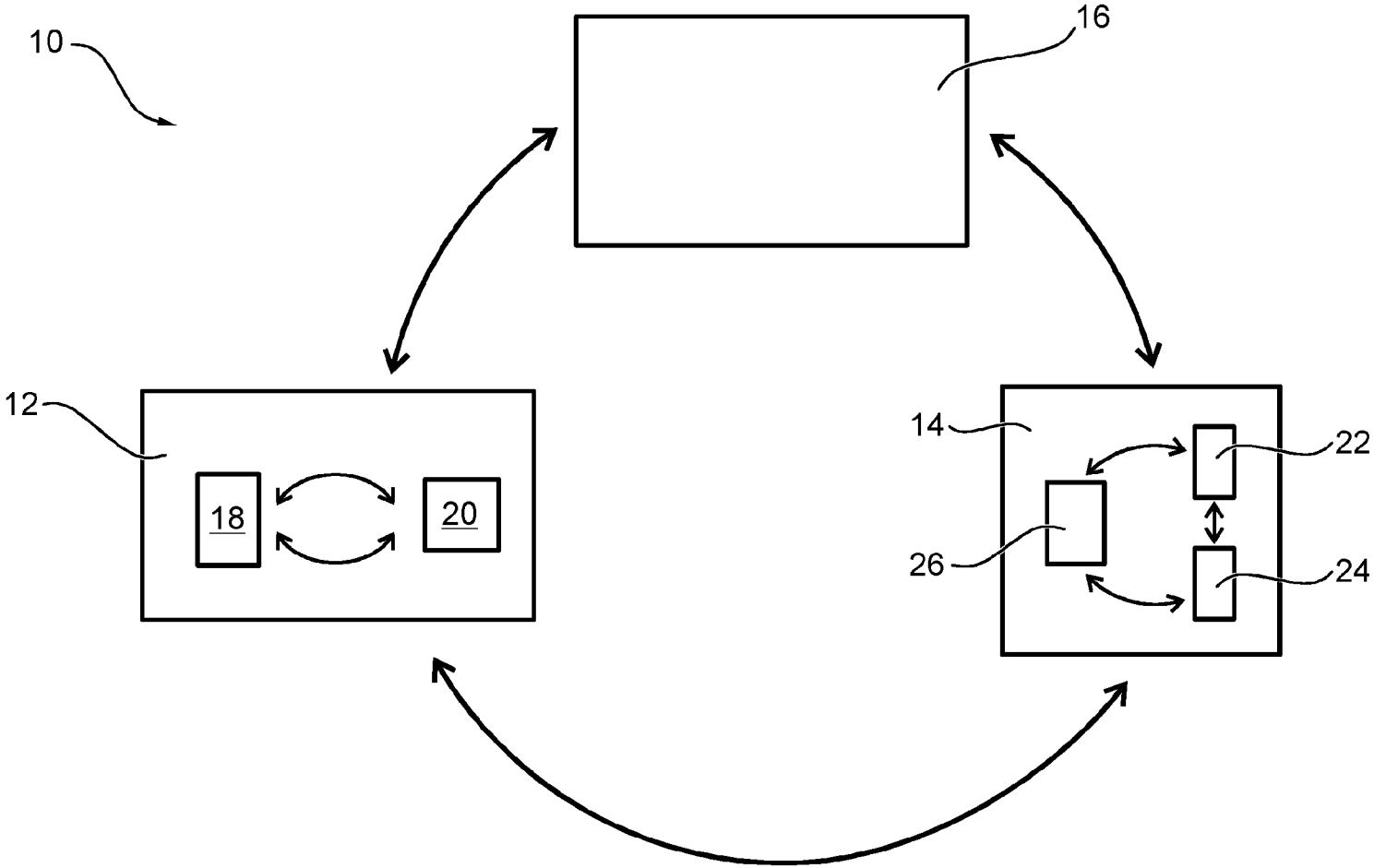
10
12
18
20
14
16
22
24
26

METHOD FOR TRANSPORTING VALUE NOTES

CROSS-REFERENCE TO RELATED APPLICATIONS

This application is a National Stage of International Application No. PCT/EP2011/062597, filed Jul. 22, 2011, and published in German as WO 2012/010681 A1 on Jan. 26, 2012. This application claims the benefit and priority of German Application No. 10 2010 036 578.5, filed Jul. 22, 2010. The entire disclosures of the above applications are incorporated herein by reference.

BACKGROUND

This section provides background information related to the present disclosure which is not necessarily prior art.

TECHNICAL FIELD

The invention relates to a method for controlling a cycle of notes of value, wherein a security transport company removes at least one cash box filled with notes of value from a device for handling notes of value and/or inserts at least one cash box filled with notes of value into the device. The removal and/or insertion of the cash box are detected by means of a sensor. Further, the invention relates to a method for controlling a cycle of notes of value, wherein a cash box filled with notes of value is removed from a first device and is supplied to a second device for handling notes of value.

DISCUSSION

In particular, devices for handling of notes of value are automated teller machines, automatic cash register systems and/or automatic cash safes. The notes of value to be dispensed from the devices and the notes value deposited in the device are stored in cash boxes. In order to guarantee the functioning of the device the cash boxes have to be re-filled in time before being completely empty, and/or to be emptied in time before being completely filled. The filling and emptying of the cash boxes is carried out by means of a security transport company that removes a cash box to be emptied from the devices and transports it to a so-called cash center in which the cash box is emptied, the notes of value are counted and the total value of all notes of value received in the cash box is credited to an account of the operator of the respective device from which the cash box had been removed. For supplying notes of value to a device a cash box that had been filled in a cash center is transported by the security transport company to the device and is inserted into it.

The problem with this method for controlling the cycle of notes of value is that for emptying and filling each cash box has to be transported to the cash center. A direct transport of a filled cash box from one device to another device is not possible, as a corresponding booking, in particular a potential transfer of ownership of the notes of value received in the cash box is not possible. This leads to substantial expenses. From document WO 2008/141679 A1 a method and a device for determining a contact point in time for contacting a money transfer system are known.

SUMMARY OF THE INVENTION

It is an object of the invention to specify a method for controlling a cycle of notes of value by means of which a direct transport of a cash box filled with notes of value is enabled from one device for handling notes of value to another device for handling notes of value.

By assigning an account memory element to the security transport company and by subtracting of the total value of all notes of value received in the cash box after removal of this cash box from the device from a value stored in the account memory element and by adding the total value of all notes of value received in the cash box to the value after insertion of the cash box into the device, it is achieved that a removed cash box does not necessarily have to be supplied to a cash center in order to add the total value of all notes of value received in the cash box for the notes of value to a value stored in an account memory element of the operator of the device, but by means of subtracting this total value from the value stored in the account memory element of the security transport company, the security transport company can get the control over the cash box and the notes of value contained therein, and thus is able to insert the cash box for example directly into another device for handling notes of value.

The removal of the cash box from the device and the insertion of the cash box into the device are carried out by an employee of the security transport company. For the sake of simplicity in the following it is abstained from mentioning every time that the removal and insertion are carried out by an employee. Instead, it is simply referred to removal and insertion by the security transport company.

By subtracting the total value of all notes of value received in the cash box from the value stored in the account memory element of the security transport company in particular the ownership of the notes of value is transferred to the security transport company. The security transport company is the owner of the notes of value received in the cash box to be supplied until the cash box has been inserted into the device and the total value of the notes of value received in the cash box has been added to the value stored in the account memory element of the security transport company for notes of value.

The value stored in the account memory element assigned to the security transport company can be compared to the account balance of an account of the security transport company. When removing a cash box from a device for handling notes of value the total value of the notes of value contained in the cash box is subtracted from the current account balance and the account is accordingly debited. Vice versa, when inserting the cash box the total value of all notes of value received in the cash box is added to the current account balance of the security transport company and thus credited to the account. The account memory element can be held in particular in form of a regular bank account with any bank.

The security transport company is in particular in charge of at least two, preferably a plurality of devices for handling notes of value and for this purpose removes cash boxes filled with the notes of value from the devices and/or inserts cash boxes into the device. After each removal of a cash box the total value of all notes of value received in the cash box is read out from a memory region of a memory element and is subtracted from the value stored in the account memory element assigned to the security transport company. The memory element can for example be a memory element of the cash box, of a device for handling notes of value or of a central data processing unit. Vice versa, after insertion of a cash box the total value is read out and is added to the value. The removal of a cash box by the security transport company is thus booked like a "normal" disbursement of notes of value to an operator. Vice versa, the insertion of a cash box is booked like a "normal" depositing of notes of value. By this, on the whole, a simple booking of the notes of value, in particular a simple booking of the cash flow associated with the transport of the notes of value is achieved.

In a preferred embodiment of the invention an account memory element is assigned to each device for handling notes of value. After insertion of a cash box into a device the total value of all notes of value received in the cash box is subtracted from a value stored in the account memory element assigned to the respective device. Vice versa, after removal of the cash box the total value of all notes of value received in the cash box is added to the value stored in the corresponding account memory element. Thus, it is achieved that at any time the current supply of notes of value of the device is known and that the corresponding contra entry is carried out to the adding or subtracting of the total value of the notes of value, or respectively from the value stored in the account memory element of the security transport company, so that the sums of all values stored in all account memory elements remain the same.

Further, it is advantageous if the security transport company supplies at least one removed cash box to a cash center for emptying. The operator of the device from which this at least one cash box has been removed is assigned an account memory element. The total value of all notes of value received in the cash box is added to a value stored in this account memory element. In the same way, the total value is added to the value stored in the account memory element of the security transport company.

In an especially preferred embodiment of the invention the security transport company removes a cash box from the first device, transports this cash box to the second device and inserts the cash box into this second device. After removal of the cash box from the first device the total value of all notes of value received in the cash box is subtracted from the value stored in the account memory element of the security transport company. Vice versa, this total value is added to a value stored in an account memory element assigned to a first device. After the security transport company has inserted the cash box into the second device, the total value of all notes of value received in the cash box is again added to the value stored in the account memory element of the security transport company, so that the value stored in the account memory element of the security transport company has again the same value as before removal of the cash box from the first device. Vice versa, after removal of the cash box this total value is subtracted from a value stored in an account memory element assigned to the second device. In this way it is achieved that the cash box can be replaced directly between the first and the second device, without requiring the cash box to be supplied beforehand to a cash center for emptying and subsequent filling. In this way the necessary transport paths are minimized. In particular, in this way also cash boxes between automated teller machines of different branch banks and/or between automated teller machines and automatic cash register systems and automatic cash safes of commercial enterprises can be replaced. In particular, by this all in all a closed cash cycle is made possible.

The security transport company itself or respectively the corresponding employee of the security transport company authorizes and/or authenticates himself before removal of a cash box and/or before insertion of a cash box. This is especially carried out by means of a chip and/or magnetic stripe card, an identification number and/or by means of data determined by a biometric identification method. If the device is supplied with cash boxes from the front side, i.e. the side from which the device is operated by a user, a card reader can be used for inserting the chip and/or magnetic stripe card that is also used by the users. Correspondingly, the PIN can be entered via the keyboard by means of which the user also operates the device. However, if the device and the rear side opposite to the device are supplied with cash boxes it is advantageous if the employees of the security transport company are provided with a separate card reader and/or a separate keyboard, so that authorization and authentication are also possible from the rear side of the device. By this, the handling is simplified and the time necessary for inserting and removing of the cash box is minimized.

A further aspect of the invention relates to a method for controlling a cash cycle, wherein a cash box filled with notes of value is removed from a first device and supplied to a second device. Here, the total value of all notes of value received in the cash box is added to a value stored in an account memory element assigned to the first device, and this total value is subtracted from a value stored in an account memory element assigned to the second device. Subtracting and adding of the total values can each be carried out after removal or insertion. In this way, it is achieved that the direct supply of a cash box removed from the first device to the second device is possible without prior emptying and filling of the cash box in a cash center and without the security transport company in charge of the transport is assigned an account memory element in which a value is stored from which at first the total value of all notes of value received in the cash box is subtracted and to which after insertion of the cash box into the second device is added again. The transport of the cash box from the first device to the second device is therefore booked comparably to a "normal" bank-wise transfer from one account to another account.

In an especially preferred embodiment of the invention cash boxes are used that each comprise a memory element in each of which at least the current total value of the notes of value received in the cash box is stored. After removal and/or insertion of the cash box the total value required for adding or subtracting is read out from this memory element. In an especially preferred embodiment of the invention in the memory element in addition to the total value of all notes of value received in the cash box also the number and/or the nominal value of all notes of value received are stored.

Additionally or alternatively, the total value of all notes of value received in the cash box can also be stored in a memory region of a memory element of a central data processing unit. In particular, all cash boxes and/or devices for handling notes of value are connected to the central data processing unit via a wireless or a wire-bound data transmission link. In this way, during the entire process there is an overview of the respective stocks of the devices and cash boxes of notes of value.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed FIGURE explains the invention in more detail with reference to embodiments.

FIG. 1 shows a schematic, greatly simplified illustration of a cash cycle.

Corresponding reference numerals indicate corresponding parts throughout the several views of the drawing.

DETAILED DESCRIPTION OF THE PREFERRED EMBODIMENTS

Example embodiments will now be described more fully with reference to the accompanying drawing.

FIG. 1 is a schematic, greatly simplified illustration of a cash cycle 10. For the sake of simplicity the illustrated cash cycle 10 only shows one bank branch 12, one retail branch 14 and one cash center 16. In alternative cash cycles also more than one bank branch 12, more than one retail branch 14 and/or more than one cash center 16 can be integrated.

In the branch bank 12 two automated teller machines 18, 20 are arranged, wherein the automated teller machines 18, 20 are mere cash deposit machines, mere cash dispensing machines and/or cash recycling machines, in which notes of value can be deposited and withdrawn. In the present embodiment in the retail branch 14 two automatic cash safes 22, 24 are arranged. In a back office of the retail branch 14 a consolidator 26 is provided by means of which the automatic cash safes 22, 24 can be supplied with notes of value and in which the notes of value deposited in the automatic cash safes 22, 24 can be disposed of.

The storing of the notes of value in the automated teller machines 18, 20, the automatic cash safes 22, 24 and the consolidator 26 can take place in stationary drum modules or cash boxes. In case of cash boxes the notes of value can be stored onto drum modules by winding them between two foils as well as by storing them in a receiving compartment in stacked form. For the sake of simplicity in the description the automated teller machines 18, 20, the automatic cash safes 22, 24 and the consolidator 26 are in the following also designated as device 18 to 26 for handling of notes of value or simply as devices 18 to 26.

If in a cash box the maximum amount of notes of value that can be received are received or if a predetermined upper limit value has been exceeded the cash box is removed from the device 18 to 26 by an employee of the security transport company. Subsequently, a new cash box is inserted so that the device 18 to 26 can be operated further. Vice versa, if a cash box is empty or if the number of notes of value has fallen below a predetermined lower limit value the cash box is removed and a new cash box filled with notes of value is inserted into the device 18 to 26.

In case of the prior art methods for controlling a cash cycle 10 the removed cash boxes are always mandatorily transported to the cash center 16, where the notes of value are removed from the cash boxes, are counted and where the total value of all notes of value received in a cash box is added to a value of an account memory element of the operator of the device 18 to 26 from which the cash box was removed. Subsequently, the cash box is filled with notes of value in the cash center 16 and is transported to one of the devices 18 to 26.

By means of the method for controlling the cash cycle 10 described below it is achieved that after removal or prior to supplying the cash boxes to one of the devices 18 to 26 the cash boxes do not always have to be supplied to the cash center 16 or to be transported from a cash center 16 to the device 18 to 26, but can be replaced directly between the devices 18 to 26.

If an employee of the security transport company removes a cash box from one of the devices 18 to 26 the total value of all notes of value received in the cash box is read out from a memory region of a memory element and is subtracted from a value stored in an account memory element of the security transport company. Finally, the cash box is supplied from the device 18 to 26 from which it was to removed to another device 18 to 26 or to the cash center 16 by the security transport company. After inserting the cash box into the corresponding device 18 to 26 or after emptying the cash box in the cash center 16 the total value of all notes of value received in the cash box is again added to the value stored in the account memory element of the security transport company.

Thus, the removal of a cash box by an employee of the security transport company is treated as a disbursement of the corresponding sum to the security transport company, and the ownership of notes of value received in the removed cash box is transferred to the security transport company. Thus, the security transport company is free to decide where the removed cash box is to be transported to. In particular, by this the security transport company is enabled to optimize the points of time for supplying individual devices 18 to 26 with cash boxes according to its own internal criteria and thus to save effort and costs.

Vice versa, the insertion of a cash box into one of the devices 18 to 26 is treated like a depositing of the notes of value received in the cash box in the corresponding device 18 to 26. By means of the corresponding adding of the total value of the notes of value to the value stored in the account memory element of the security transport company the ownership of notes of value stored in the cash box is transferred to the operator of the devices 18 to 26.

Further, each device 18 to 26 is assigned an account memory element in each of which at least one value is stored. After removing a cash box from a device 18 to 26 the total value of all notes of value contained in the removed cash box is added to the value stored in the account memory element assigned to the device 18 to 26.

Vice versa, after inserting a cash box into a device 18 to 26 the total value of all notes of value received in the cash box is subtracted from the value stored in the account memory element of the device 18 to 26.

In an alternative embodiment of the invention after removal of a cash box from one of the devices 18 to 26, if this cash box is directly to be supplied to another device 18 to 26, the value of the account memory element of the security transport company can remain unchanged and, after insertion of the cash box into the other device 18 to 26 the total value of all notes of value received in the cash box is read out from the memory region of the corresponding memory element, is subtracted from the value stored in the account memory element of the other device 18 to 26 and is added to the value stored in the account memory element of the removed device 18 to 26. In this case, the expenses are reduced, as it is not necessary to subtract in advance the total value from the value of the account memory element of the security transport company and then to add this value again. In this case, the transport of a cash box from a device 18 to 26 to another device 18 to 26 is handled like a bank-wise transfer from one account to another account. This is especially advantageous if to the value stored in one of the account memory elements a further value that is time-dependent and that is dependent from the value stored in the account memory element is in each case added or subtracted. This time-dependent and value-dependent further value can especially be in form of interests. By means of direct charging the total value of the notes of value received in the cash box when transporting the cash box from one device 18 to 26 to the other device 18 to 26 consequently no interest costs occur for the security transport company.

By means of the above-described method for controlling the cash cycle 10 it is achieved that within the bank branch 12 the cash boxes are replaced directly between the automated teller machines 18 and 20, directly between the automatic cash safes 22, 24, between the consolidator 26 and one of the automatic cash safes 22, 24 and directly between a device 18, 20 arranged at a bank branch 12 and a device 22 to 26 arranged in the retail branch 14.

The removal of a cash box from a device 18 to 26 or the insertion of a cash box into a device 18 to 26 is in particular detected via a sensor. In dependence of a signal generated by this sensor the total value is read out from the memory region of the memory element and is added to the values or subtracted from the values of the values of the respective account memory elements.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A method for controlling a cycle of notes of value, comprising:

wherein a security transport company removes from a device for handling notes of value at least one cash box filled with notes of value and/or inserts at least one cash box filled with notes of value into the device, removal and/or insertion of the cash box is detected by means of a sensor, wherein:

after removal of a cash box from the device in dependence of a signal of the sensor of a memory region of a memory element the total value of all notes of value received in the cash box is read out and is subtracted from a value stored in an account memory element assigned to the security transport company, and after insertion of a cash box into the device in dependence of a signal of the sensor the total value of all notes of value received in the cash box is read out from the memory region and is added to the value stored in the account memory element assigned to the security transport company.

2. The method according to claim 1, wherein cash boxes filled with notes of value are removed from and/or inserted into at least two devices for handling of notes of value, preferably a plurality of devices for handling of notes of value by the security transport company, that after each removal of a cash box from the memory region of a memory element the total value of all notes of value received in the cash box is read out and is subtracted from the value stored in the account memory element assigned to the security transport company, and that after each insertion of a cash box from the memory region the total value of all notes of value received in the cash box is read out and is added the value stored in the account memory element assigned to the security transport company.

3. The method according to claim 2, wherein the security transport company removes a cash box from the first device, that from the value stored in the account memory element of the security transport company the total value of all notes of value received in the cash box is subtracted, that this total value is added to a value stored in an account memory element assigned to the first device, that the security transport company transports the cash box to the second device and inserts the cash box into it, that the total value of all notes of value received in the cash box is then added to a value stored in the account memory element of the security transport company, and that this total value is subtracted from a value stored in an account memory element assigned to the second device.

4. The method according to claim 3, wherein the security transport company inserts the cash box removed from the first device into the second device without filling and/or emptying the cash box first.

5. The method according to claim 1, wherein after insertion of a cash box into a device the total value of all notes of value received in the cash box is subtracted from a value stored in an account memory element assigned to the device, and that after removal of a cash box from the device the total value of all notes of value received in the cash box is added to the value stored in the account memory element assigned to the device.

6. The method according to claim 1, wherein the security transport company supplies at least one removed cash box to a cash center for emptying, that to a value stored in an account memory element assigned to the operator of the device from which the at least one cash box was removed the total value of all notes of value received in the cash box is added, and that to the value stored in the account memory element of the security transport company the total value of all notes of value received in the cash box is added.

7. The method according to claim 1, wherein prior to removal of a cash box and/or prior to insertion of a cash box the security transport company authorizes and/or authenticates itself by means of a chip and/or magnetic stripe card, an identification number (PIN) and/or biometric data.

8. The method according to claim 1, wherein the total value of all notes of value received in the cash box is read out from a memory region of a memory element of the respective cash box.

9. The method according to claim 1, wherein the total value of all notes of value received in the cash box is read out from a memory region of a memory element of a central data processing unit.

10. A method for controlling a cycle of notes of value, comprising:

wherein a cash box filled with notes of value is removed from a first device, the cash box is transported to a second device for handling notes of value and is inserted into the second device, the total value of all notes of value received in the cash box is added to a value stored in an account memory element assigned to the first device, and wherein the total value of all notes of value received in the cash box is subtracted from the value stored in an account memory element assigned to the second device.

11. The method according to claim 10, wherein the cash box removed from the first device is inserted into the second device without being emptied and/or filled first.

12. A method for controlling a cycle of notes of value when a security transport company at least one of removes a cash box from a device for handling notes of value or inserts the cash box into the device for handling notes of value, a cash box value of the cash box represents a total value of notes within the cash box, the method comprising:

subtracting the cash box value from a transport company value stored in an account memory element assigned to the transport company after removal of the cash box from the device for handling bank notes; and adding the cash box value to the transport company value after insertion of the case box within the device for handling bank notes; and detecting with a sensor at least one of removal or insertion of the cash box within the device for handling bank notes.

13. The method of claim 12, wherein the device for handling bank notes is a first device for handling bank notes, the method further comprising:

subtracting the cash box value from the transport company value after removal of the cash box from a second device for handling bank notes; and adding the cash box value to the transport company value after insertion of the case box within the second device for handling bank notes.

14. The method of claim 13, further comprising:

subtracting the cash box value from a first device value stored in an account memory element assigned to the first device for handling banknotes after insertion of the cash box into the first device for handling bank notes;

adding the cash box value to the first device value after removal of the cash box from the first device for handling bank notes;

subtracting the cash box value from a second device value stored in an account memory element assigned to the second device for handling bank notes after insertion of the cash box into the second device for handling bank notes; and adding the cash box value to the second device value after removal of the cash box from the second device for handling bank notes.

15. The method of claim 14, wherein the transport company inserts the cash box removed from the first device into the second device without at least one of filling or emptying the cash box first.

16. The method of claim 12, further comprising:

subtracting the cash box value from a device value stored in an account memory element assigned to the device for handling banknotes after insertion of the cash box into the device for handling bank notes; and adding the cash box value to the device value after removal of the cash box from the device for handling bank notes.

17. The method of claim 12, further comprising:

adding the cash box value to an operator value stored in an account memory element assigned to an operator of the device for handling bank notes when the transport company supplies the cash box to a cash center for emptying.

18. The method of claim 12, further comprising authenticating the transport company prior to insertion and removal of the cash box from the device for handling bank notes.

* * * * *